United States Patent [19]

Nishimaki

[11] Patent Number: 4,739,716

[45] Date of Patent: Apr. 26, 1988

[54] MULTIPLE-NEEDLE SEWING MACHINE

[75] Inventor: Shigetsugu Nishimaki, Ueda, Japan

[73] Assignee: Vari-O-Matic Machine Kabushiki Kaisha, Ueda, Japan

[21] Appl. No.: 880,226

[22] Filed: Jun. 30, 1986

[30] Foreign Application Priority Data

Dec. 21, 1985 [JP] Japan ..... 60-197177[U]

[51] Int. Cl.[4] ..... D05B 1/08

[52] U.S. Cl. ..... 112/163

[58] Field of Search ..... 112/163, 164, 165, 166, 112/167, 80.45

[56] References Cited

U.S. PATENT DOCUMENTS 961,207 6/1910 Chatfield ..... 112/163
3,019,748 2/1962 Card ..... 112/80.4
3,919,942 11/1975 Galya et al. ..... 112/166
4,483,261 11/1984 Green ..... 112/80.45
4,559,883 12/1985 Lemke ..... 112/166

*Primary Examiner*—Ronald Feldbaum
*Attorney, Agent, or Firm*—Jordan and Hamburg

[57] ABSTRACT

Needles of a multiple-needle sewing machine are set on its needle holder so that the form which the needle tips form is not in alignment in parallel with the surface of a cloth to be sewn but deviates from the surface in vertical direction.

Accordingly, since plural needles will stick into a cloth not all at once but with time lags, the forces exerted on the needles, needle holder, needle rods, etc. may be dispersed. It is also possible that more needles may be used than the conventional multiple-needle sewing machine.

7 Claims, 5 Drawing Sheets

MULTIPLE-NEEDLE SEWING MACHINE

DESCRIPTION OF THE RELATED ART

The sewing systems adopted for the sewing machine are divided into lock stitch sewing, single chainstitch sewing, double chainstitch sewing, etc.

The sewing machine for home use adopts the direct sewing system. On the other hand, some so-called industrial sewing machines are multiple-needle sewing machines which are provided with a lot of needles and are capable of lock stitch sewing, single chainstitch sewing, and double chainstitch sewing.

In the multiple-needle sewing machine, each needle is provided with the known structure containing a looper or a hook. In addition, the tips of the needles of a multiple-needle sewing machine are in horizontal alignment so that all the needles stick into a cloth surface all at once.

FIG. 9 shows a perspective view of an example of a multiple-needle sewing machine.

A needle rod 2 extends downward from a needle-rod case 1. A needle holder 3 is attached at the end of the needle rod 2 and plural needles 4 are fixed on the needle holder 3.

A bed 5 contains the known internal mechanism consisting of looper, retainer, etc.

When the above-described conventional multiple-needle sewing machine is being used for sewing a cloth, a number of needles 4 stick into the cloth surface all at once with high speed, with the sum of the forces which each needle 4 receives exerted on the needle holder 3, needle rod 2, and the other driving mechanism. Therefore, it is necessary to increase the strength of each component of the needle holder 3, needle rod 2, etc. Moreover, a motor of large torque is required as the driving source.

Furthermore, in the case where the needles 4 penetrate a cloth all at once, there are involved a number of problems such as that the force conveyed from the driving source is dispersed to each needle 4, the reduced force on each needle causes the position of sticking of needle 4 into a cloth surface to deviate, the seam becomes irregular, and that the seam gets curved. These problems are pronounced as the number of needles is increased. Sometimes, the force exerted on the needle 4, needle holder 3, needle rod 2, etc. may become so large as to cause each component to get deformed.

SUMMARY OF THE INVENTION

The situation being as described above, the object of this invention is to provide a multiple-needle sewing machine which is capable of reducing the force exerted on the driving components such as the needle holder and needle rod when plural needles stick into a cloth and of increasing the number of needles to be attached on the needle holder.

The structure of the multiple-needle sewing machine is such that the distances from the tips of the plural needles on the needle holder to the surface of a cloth to be sewn are different for each needle or group of needles. Therefore, the plural needles on the needle holder of the multiple-needle sewing machine stick into a cloth with time lags, so that the needle holder and needle rod will receive no concentrated force but dispersed force. Such a structure requires no driving motor of large torque and allows increase in the number of needles applied on the needle holder even by using a motor of the same torque as the conventional motor.

SPECIFICATION OF THE INVENTION

Below will be made a concrete description of preferred embodiments of this invention.

Figure 1:
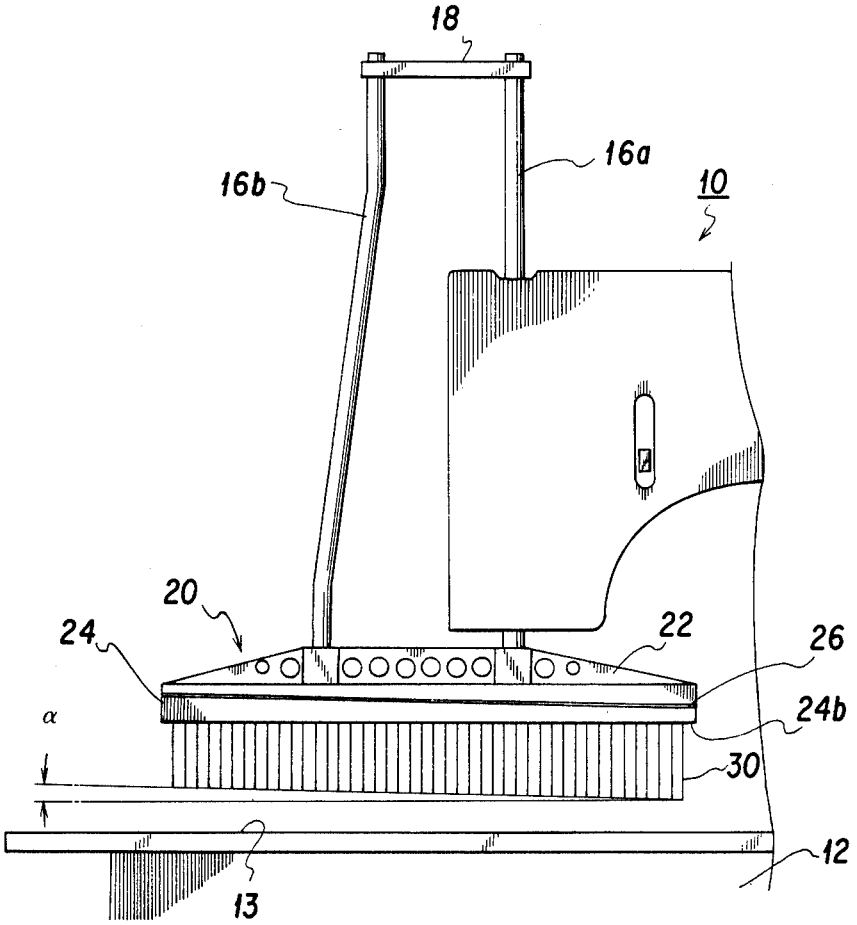
FIG. 1 is a schematic front view of the needle rod guide section of a multiple-needle sewing machine.
Figure 2:
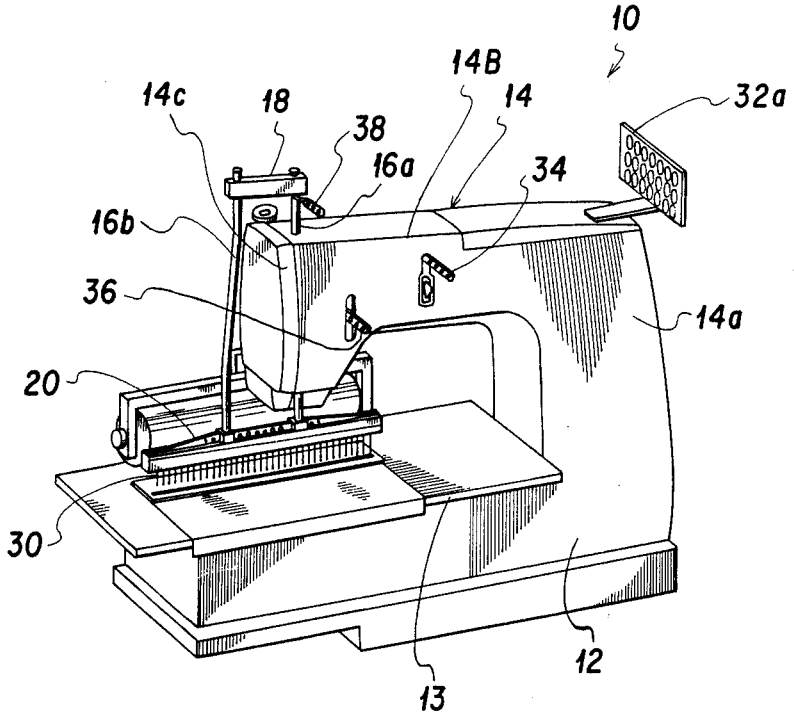
FIG. 2 is a perspective view showing the whole of a multiple-needle sewing machine.

FIG. 1 is a partial front view showing the state of setting of the multiple-needle sewing machine, and FIG. 2 is a schematic perspective view of the multiple-needle sewing machine.

An arm 14 is provided vertically from the end section of a bed 12 constituting a multiple-needle sewing machine 10. This arm 14 is composed of a vertical section 14A, a horizontal section 14B, and a needle-rod guide section 14C. A needle rod **16*a* penetrates the needle-rod guide section 14C vertically, and the needle-rod 16*a* is allowed to move up and down by the conventional internal mechanism connected to a driving source. Another needle rod 16*b* is provided approximately parallel to the needle rod 16*a*. Both the needle rods 16*a* and 16*b* are connected with each other by a connecting piece 18 at the upper ends and by a needle holding part 20** at the lower ends.

There is a cloth plate 13 on the bed 12 located below the aforementioned needle-rod guide section 14C, and there is the internal mechanism consisting of loopers, retainers, etc. (not shown) inside the bed 12 located under the cloth plate 13.

Figure 3A:
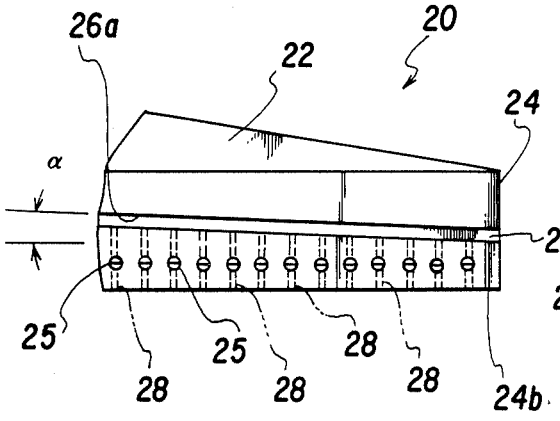
FIGS. 3A and 3B are a partial front view and a sectional side view of a needle attaching part, respectively.
Figure 3B:
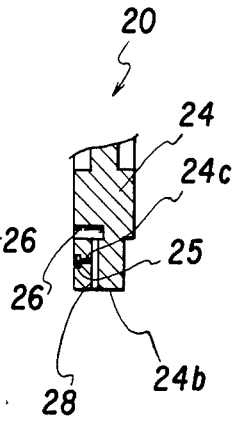

The aforementioned needle holding part 20 consists of a reinforcing rib 22 and a needle holder 24. The reinforcing rib 22 is fixed detachably at the lower ends of both the needle rods **16*a* and 16*b*. On the front face of the needle holder 24 there is engraved a groove 26 with an inclination angle $\alpha$, and this groove 26 is opened to both the end faces of the needle holder 24. Holes 28 are bored at regular intervals from the bottom face 24*b* of the needle holder 24 to the groove 26. With such a structure, the upper ends of needles 30 applied in the holes 28 will be in contact with the upper face 26*a* of the groove 26, so that the tips of the needles 30 are aligned with the inclination angle $\alpha$ of the groove 26 (see FIGS. 3A and 3B). There are bored tapped holes 24*c* from the front face of the needle holder 24 to the holes 28, and a screw 25 applied in this tapped hole 24*c* fixes the needle 30 applied in the hole 28**.

An upper thread is passed through a needle hole (not shown) at the lower end of needle 30, for example, via an upper-thread guide plate **32*a* at the upper end of the vertical section 14A of the arm 14, a guide 34 on the horizontal section 14B of the arm 14, a balance 36, a guide 38 at the top of the needle-rod guide section 14C**. On the other hand, a lower thread is passed through a thread hole of a looper (not shown) via suitable guides.

Since the multiple-needle sewing machine has the above-described structure, in sewing a cloth each of the needles 30 sticks into the cloth successively with time lags. Therefore, the resistance against the sticking of the needles 30 is scattered over each of them and no large force will be exerted all at once on the needle holding part 20 or each of the needle rods 16*a* and 16*b*.

Figure 4:
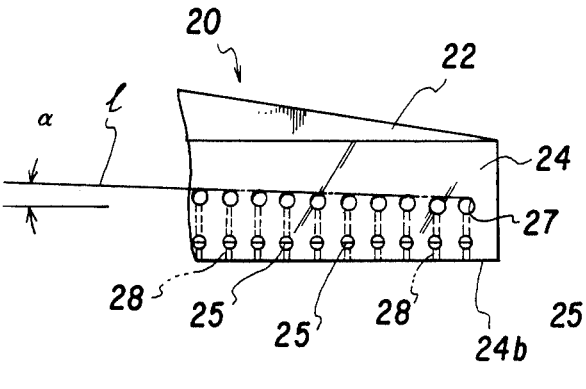
FIGS. 4A and 4B are a partial front view and a sectional side view of another needle attaching part, respectively.
Figure 4B:
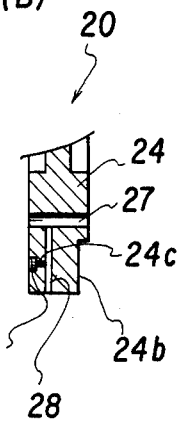

A needle holder 24 of another structure available for the aforementioned embodiment will be described below by reference to FIGS. 4A and 4B.

On the front face of the needle holder 24 through-holes 27 of the same diameter are bored at prescribed intervals so that the imaginary line l connecting the upper positions of the through-holes 27 has an inclination angle $\alpha$. Holes 28 are bored from the bottom face 24*b* of the needle holder 24 to the through-holes 27. Thus, needles 30 inserted into the holes 28 are fixed in contact with the uppermost positions of the through-holes 27, resulting in a linear alignment of the tips of the needles 30 with an inclination angle the same as $\alpha$ of the imaginary line l. Note that the through-hole may be replaced by a hole of a prescribed depth; the present invention contains both the concepts of holes.

Next, examples of modifications will be described with respect to forms which the tips of needles 30 form.

Figure 5:
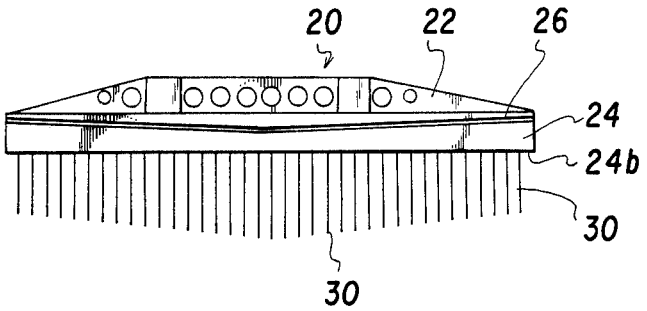
FIGS. 5–8 are front views showing states of attachment of other needles on the needle attaching part.

FIG. 5 shows a case where the form which the tips of needles 30 form is made of a low (stretched) V shape. In this case, a groove 26 is engraved on the front face of needle holder 24 in a stretched V shape, holes 28 are bored from the bottom face 24*b* of needle holder 24 as already described, and needles 30 are applied on the holes 28. In this case the needle at almost the middle position has been made lowest, but the needle not at the middle position but at a position a little apart from the middle position may be made the lowest. Also in these cases, as in the aforementioned example of embodiment, no large force will be exerted all at once on the needle holding part 20 or each of the needle rods 14*a* and 14*b* since the tips of needle 30 are not in alignment.

Figure 6:
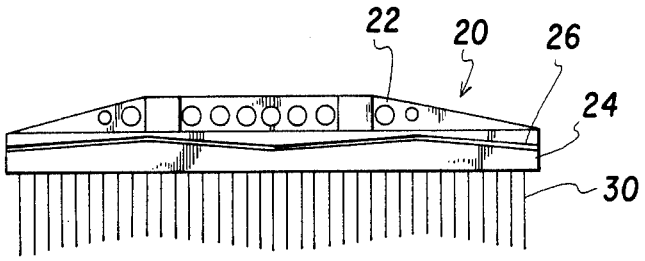

The form which the tips of the needles 30 form may be made zigzag as shown in FIG. 6; the structure for the application of the needles 30 on the needle holding part 20 is the same as described above.

Figure 7:
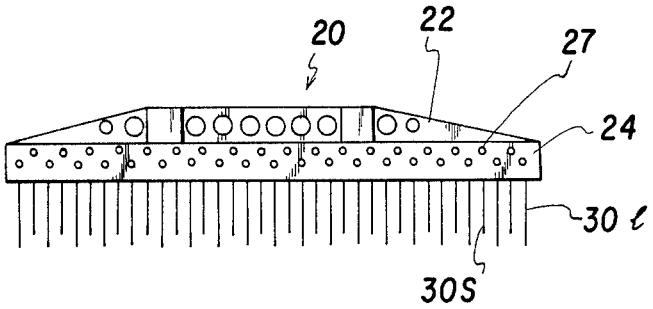

In FIG. 7 is shown another type of needle holding part 20 in which short needles 30*s* and long needles 30*l* are alternately inserted into the needle holder 24 and fixed. In this case, the resistance against the sticking of the needles into a cloth is made half. In this case, through-holes 27 are bored on the needle holder 24 and holes 28 are formed toward these through-holes 27, but the needles of short needles 30*s* or long needles 30*l* may be made different in length properly.

Figure 8:
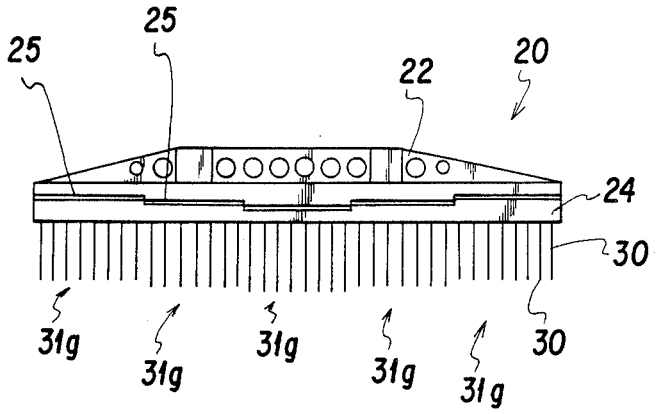
Figure 9:
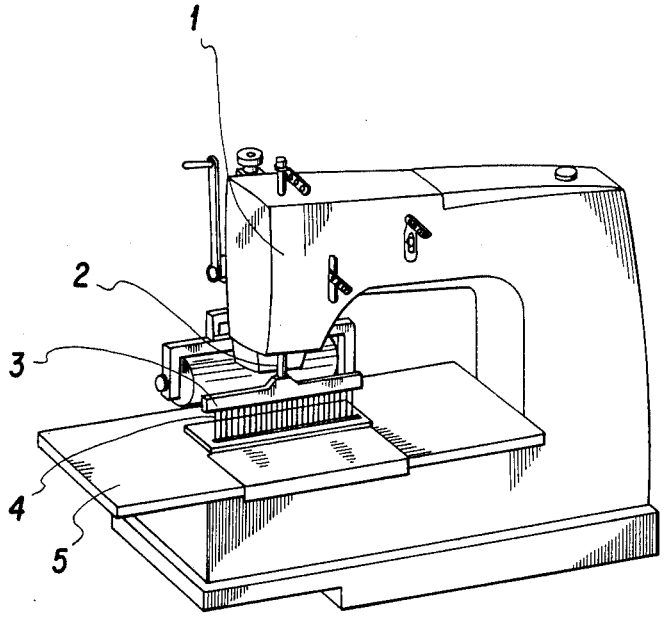
FIG. 9 is a perspective view of the conventional multiple-needle sewing machine.

FIG. 8 shows a case in which a plurality of needles 30 is divided into a plurality of needle groups 31*g*, which are disposed as to elevate from the middle toward both the ends. In this case, short grooves 25 are engraved on the front face of the needle holder 24 in a series of steps, and holes 28 (not shown in FIG. 8) are bored to these grooves 25. Needles 30 are applied on these holes 28. It is applicable to make the needles 30 in each needle group 31*g* suitably different in length.

For each of the above-described embodiments, the vertical difference in the positions of the tips of needles 30 is preferably several millimeters (below 2 mm) and this difference will necessitate no adjustments on the internal mechanism of the multiple-needle sewing machine such as the looper and retainer. If a larger vertical difference is to be adopted, the internal mechanism has only to be adjusted. Moreover, the forms which the tips of the needle groups form are not restricted to those of the above-described embodiments but may be various forms including curved forms. In general, many modifications may be adopted within the scope not deviating from the spirit of the invention, for example, the number or shape of the needle rods supporting the needle holding part may be suitably altered.

As described above, according to the present invention, the tips of the needles applied on the needle holder are never in alignment and accordingly there are time lags for the sticking of needle tips into a cloth, so that the forces exerted on the needle holder, needle rods, etc. may be highly dispersed as compared with the conventional multiple-needle sewing machine having the same number of needles. Therefore, remarkable effects may be obtained such as that the conventional multiple-needle sewing machine may be used, as it is, with an increased number of needles without increasing the strength of needle rod, driving mechanism, etc. or the torque of the motor as the driving source.

I claim:

1. In a multiple needle sewing machine having a plurality of needles attached in parallel on the needle holder thereof, the improvement comprising:

a groove of a prescribed depth engraved on a lengthwise face of said needle holder, said groove being inclined so as to be lower at one thereof, plural holes for needle insertion bored from the bottom face of said needle holder and terminating in said groove;

each of said holes having fixing means for holding a needle inserted therein so that the top of the respective needle abuts the upper face of said groove, said needles having substantially the same length; and said groove engraved on said needle holder extending in a direction so that the distances of the tips of said needles fixed as specified above to the surface of a cloth to be sewn are different for each needle or for each group of needles.

2. A multiple-needle sewing machine according to claim 1 wherein said groove engraved on said needle holder is zigzag in the vertical direction.

3. A multiple-needle sewing machine according to claim 1 wherein said groove engraved on said needle holder consists of plural sections located with deviations in the vertical direction.

4. In a multiple-needle sewing machine having a plurality of needles attached in parallel on the needle holder thereof, the improvement comprising:

plural first holes bored in said needle holder from a lengthwise face thereof, a line connecting upper ends of said holes being inclined from one end to the other end;

plural second holes for needle insertion bored upwardly from the bottom face of said needle holder;

each of said second holes having a fixing means for holding a needle inserted therein so that the top of the respective needle abuts the upper surface of one of said first holes, said needles having substantially the same length; and wherein a line connecting upper ends of at least some of said plural holes bored on said needle holder extends in a direction so that the distances of the tips of said needles fixed as specified above to the surface of a cloth to be sewn are different for each needle or for each group of needles.

5. A multiple-needle sewing machine according to claim 4 wherein the line connecting the upper ends of said plural holes bored on said needle holder is zigzag in the vertical direction.

6. A multiple-needle sewing machine according to claim 4 wherein said plural holes bored on said needle holder are located with deviations in the vertical direction.

7. A multiple-needle sewing machine according to claim 4 wherein said plural holes engraved on said needle holder are divided into plural groups and the positions of the holes in each group are located with deviations in the vertical direction.

* * * * *